US008839485B2

(12) United States Patent
Morgan

(10) Patent No.: US 8,839,485 B2
(45) **Date of Patent: *Sep. 23, 2014**

(54) UPRIGHT VACUUM WITH FLOATING HEAD

(71) Applicant: Techtronic Floor Care Technology Limited, Tortola (VG)

(72) Inventor: Charles J. Morgan, Sparta, TN (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 14/015,113

(22) Filed: Aug. 30, 2013

(65) Prior Publication Data

US 2013/0340202 A1 Dec. 26, 2013

Related U.S. Application Data

(63) Continuation of application No. 12/771,865, filed on Apr. 30, 2010, now Pat. No. 8,528,166.

(51) Int. Cl.

| | |
|---|---|
| ***A47L 9/00*** | (2006.01) |
| ***A47L 9/28*** | (2006.01) |
| ***A47L 5/30*** | (2006.01) |
| ***A47L 5/32*** | (2006.01) |
| ***A47L 5/34*** | (2006.01) |

(52) U.S. Cl.

CPC ..... *A47L 5/34* (2013.01); *A47L 9/2842* (2013.01); *A47L 9/2805* (2013.01); *A47L 9/2857* (2013.01); *A47L 5/30* (2013.01); *A47L 9/0081* (2013.01); *A47L 9/2831* (2013.01); *A47L 5/32* (2013.01); *A47L 9/2889* (2013.01); *A47L 9/2894* (2013.01)

USPC ..... 15/410; 15/350; 15/351; 15/411

(58) Field of Classification Search
None
See application file for complete search history.

(56) References Cited

U.S. PATENT DOCUMENTS

| | | | |
|---|---|---|---|
| 1,104,612 | A | 7/1914 | Bodey |
| 1,108,248 | A | 8/1914 | Schmitz |
| 1,140,922 | A | 5/1915 | Soule |
| 1,210,522 | A | 1/1917 | Orr |
| 1,282,548 | A | 10/1918 | De Reamer |
| 1,286,115 | A | 11/1918 | Rosenfield |
| 1,288,312 | A | 12/1918 | Wagner |
| 1,333,682 | A | 3/1920 | Robertson |
| 1,437,996 | A | 12/1922 | Robertson |

(Continued)

FOREIGN PATENT DOCUMENTS

| | | |
|---|---|---|
| DE | 102008007985 | 8/2009 |
| GB | 525889 | 9/1940 |

(Continued)

OTHER PUBLICATIONS

GB1106816.0 Search Report dated Aug. 19, 2011 (27 pages).

*Primary Examiner* — Brian Glessner
*Assistant Examiner* — Beth Stephan
(74) *Attorney, Agent, or Firm* — Michael Best & Friedrich LLP

(57) ABSTRACT

A vacuum cleaner with a reduced frictional force between a vacuum base and a cleaning medium is described. The vacuum has a handle, yoke, body, and base. A handle and yoke distinct from, and behind, the base provides a moment arm anterior to the base when a force is applied. The handle and yoke assembly reduce the friction between the cleaning surface and the vacuum, allowing for larger motor and debris capturing capabilities, with easier handling and maneuverability resulting in advanced and superior cleaning capabilities.

8 Claims, 13 Drawing Sheets

(56) References Cited

U.S. PATENT DOCUMENTS

| | | | |
|---|---|---|---|
| 1,530,575 | A | 3/1925 | Pearl |
| 1,556,021 | A | 10/1925 | Orr |
| 1,587,794 | A | 6/1926 | O'Brien |
| 1,591,325 | A | 7/1926 | Kirby |
| 1,647,292 | A | 11/1927 | Hill |
| 1,727,922 | A | 9/1929 | Adams |
| 1,843,901 | A | 2/1932 | Pardee |
| 1,879,710 | A | 9/1932 | Reddig |
| 1,903,855 | A | 4/1933 | Townsend |
| 1,918,695 | A | 7/1933 | Gilbert |
| 2,017,905 | A | 10/1935 | Kitto |
| 2,028,090 | A | 1/1936 | Frantz |
| 2,031,911 | A | 2/1936 | Smellie |
| 2,044,830 | A | 6/1936 | Carlstedt |
| 2,058,371 | A | 10/1936 | Van Rosen |
| 2,093,748 | A | 9/1937 | Becker |
| 2,128,525 | A | 8/1938 | Dyer |
| 2,202,999 | A | 6/1940 | Smellie |
| 2,244,165 | A | 6/1941 | MacFarland et al. |
| 2,287,515 | A | 6/1942 | Dow et al. |
| 2,343,056 | A | 2/1944 | Harlett |
| 2,876,484 | A | 3/1959 | Wells |
| 3,984,735 | A | 10/1976 | Schwartz |
| D288,016 | S | 1/1987 | Watkins et al. |
| 4,786,231 | A | 11/1988 | Kelley |
| 4,858,271 | A | 8/1989 | Berfield et al. |
| 5,502,869 | A | 4/1996 | Smith et al. |
| 5,573,369 | A | 11/1996 | Du |
| 6,033,451 | A | 3/2000 | Fish et al. |
| D426,356 | S | 6/2000 | Tsuruha |
| 6,171,054 | B1 | 1/2001 | Mann, III et al. |
| 6,340,291 | B1 | 1/2002 | Reckert |
| D462,814 | S | 9/2002 | Sugimoto |
| 6,446,304 | B1 | 9/2002 | Paterson et al. |
| 6,579,060 | B1 | 6/2003 | Mann, III et al. |
| 6,591,441 | B2 | 7/2003 | Stegens et al. |
| 6,779,231 | B1 | 8/2004 | Stegens et al. |
| D498,887 | S | 11/2004 | Kent |
| 7,024,724 | B2 | 4/2006 | Ponjican et al. |
| D534,324 | S | 12/2006 | Dyson et al. |
| D544,158 | S | 6/2007 | Bobrosky |
| 7,258,709 | B2 | 8/2007 | Ponjican et al. |
| D570,561 | S | 6/2008 | Dyson et al. |
| D591,016 | S | 4/2009 | Dyson et al. |
| D596,360 | S | 7/2009 | Dyson et al. |
| 7,716,781 | B2 | 5/2010 | Cunningham et al. |
| 7,856,694 | B2 | 12/2010 | Lee et al. |
| 7,921,962 | B2 | 4/2011 | Liddell |
| 2003/0145423 | A1 | 8/2003 | Park et al. |
| 2005/0123398 | A1 | 6/2005 | Tam et al. |
| 2005/0160553 | A1 | 7/2005 | Gregory |
| 2006/0280596 | A1 | 12/2006 | Kim et al. |
| 2007/0122277 | A1 | 5/2007 | Oh et al. |
| 2007/0209145 | A1 | 9/2007 | Tullett |
| 2008/0022486 | A1 | 1/2008 | Burlington |
| 2008/0155768 | A1 | 7/2008 | Ziegler et al. |
| 2008/0172825 | A1 | 7/2008 | Weiss |
| 2009/0101187 | A1 | 4/2009 | Lenkiewicz et al. |

FOREIGN PATENT DOCUMENTS

| | | |
|---|---|---|
| GB | 2447995 | 10/2008 |
| GB | 2453616 | 4/2009 |
| GB | 2454924 | 5/2009 |
| JP | 2001304172 | 10/2001 |
| JP | 2007185413 | 7/2007 |
| JP | 2007267758 | 10/2007 |

UPRIGHT VACUUM WITH FLOATING HEAD

CROSS-REFERENCE TO RELATED APPLICATIONS

This application claims priority to U.S. patent application Ser. No. 12/771,865, filed on Apr. 30, 2010, now U.S. Pat. No. 8,528,166, the contents of which being incorporated herein by reference.

TECHNICAL FIELD

The present teachings are directed toward the improved cleaning capabilities of upright vacuum cleaners. In particular, the disclosure relates to an upright vacuum cleaner that has a handle and a yoke that is distinct from a vacuum base. The distinct yoke can provide a moment arm anterior to the base. A force applied to the vacuum handle causes the yoke and not the base to be pushed towards a cleaning surface. This reduces a frictional force of the base against a cleaning surface. The resulting reduction in friction provides a much easier vacuum to push and control for a user over a cleaning surface, and provides a "floating head."

BACKGROUND

A need has been recognized in the vacuum cleaner industry for upright model vacuum cleaners that are easy and efficient to use while providing superior cleaning abilities. The prior art upright vacuum cleaners often have the handle and the dirty air conduit attached to the base of the vacuum somewhere between the front and rear wheels. However, these designs have many drawbacks. In vacuum cleaners where the handle and the dirty air conduit are attached to the base of the vacuum somewhere between the front and rear wheels, a handle being pushed or pulled by a user transmits a force through the base to the floor. Because the force applied is transmitted through the vacuum cleaner base, the friction between the vacuum cleaner base and the cleaning surface is increased, as the user is actually pushing the vacuum cleaner into the floor. For instance, in high pile carpeting even a "light weight" vacuum cleaner becomes difficult to maneuver and use, as the vacuum cleaner base is becoming hindered by the very cleaning surface it is attempting to clean.

The prior art does not exemplify upright vacuum cleaners where the force transmitted by the user is direct about the vacuum base, rather than through the vacuum cleaner base. By transferring the force behind the vacuum cleaner head, the frictional force between the vacuum cleaner and the cleaning surface is significantly reduced, thereby making the cleaning experience easier, less strenuous, and quicker for the user. Another advantage is that heavier vacuum cleaners, which may provide larger motors, and debris capturing capabilities can be used with the same comfort as "lightweight" prior art models-thereby providing superior cleaning results with minimum effort.

SUMMARY

According to one embodiment, a vacuum cleaner with reduced frictional capabilities is described. In one embodiment, the vacuum comprises a handle; a yoke to receive the handle; a base distinct from the yoke; and an axle to connect the yoke to the base, wherein the yoke provides a moment arm anterior to the base, wherein the handle is disposed anterior to the axle.

In some embodiments a force applied to the handle pushes the yoke towards a cleaning surface while reducing a frictional force of the base against the cleaning surface. In some embodiments the force applied to the handle propels the base.

In some embodiments the vacuum further comprises an airflow duct exiting the base wherein the airflow duct is distinct from the handle. In some embodiments the vacuum further comprises a dirt collecting device connected to the airflow duct; and a sliding connector to connect the dirt collecting device to the handle. In some embodiments the handle is hollow and is adapted to receive an electrical cord. In some embodiments the yoke includes a handle insert, wherein the handle receives the handle insert. In some embodiments the handle insert includes an interior wall that divides the handle insert into two cavities, the interior wall includes a fastener receiver. In some embodiments the vacuum further comprises a wheel connected to the axle.

In some embodiments the base comprises a lifting device that raises the base off a cleaning surface. In some embodiments the lifting device comprises a wheel. In some embodiments the lifting device comprises a biasing device to keep the lifting device receded into the base and a ramp to expel the lifting device from the base when the handle is placed in a locked position.

According to various embodiments, a method of reducing the frictional force between a vacuum base and a cleaning medium is described, the method providing a vacuum comprising providing a handle, a yoke to receive the handle, a base distinct from the yoke, and an axle to connect the yoke to the base wherein the handle is disposed anterior to the axle; disposing the yoke to provide a moment arm anterior to the base; and applying a force to the handle which causes the yoke to be pushed towards a cleaning surface thereby reducing a frictional force of the base against a cleaning surface.

In some embodiments, the method includes expelling dirty airflow the base with an airflow duct distinct from the handle.

In some embodiments, the method includes providing a dirt collecting device connected to the airflow duct, and sliding the dirt collecting device along a longitudinal axis of the handle.

In some embodiments, the method includes raising the base off a cleaning surface when the handle is placed in a locked position.

In some embodiments, the method includes receding a lifting device into the base when the handle is placed in an unlocked position; and expelling the lifting device from the base when the handle is placed in a locked position.

According to various embodiments, a vacuum cleaner brushroll is described. The brushroll includes a spindle having first and second ends and a longitudinal axis of rotation, and bristle tufts on the spindle arranged in an angularly spaced single-helical row, wherein the bristle tufts extend from the spindle at a non-orthogonal angle.

In some embodiments, the brushroll includes a belt receiver comprising grooves. In some embodiments, the helical row rotates about the spindle prior to the helical row reversing a direction of helix rotation.

In some embodiments, the helical row rotates about one and a half times about the spindle prior to the helical row reversing a direction of helix rotation.

In some embodiments, the non-orthogonal angle is from about 70 degrees to about 85 degrees. The spindle can comprise a light wood.

BRIEF DESCRIPTION OF THE DRAWINGS

The same reference number represents the same element on all drawings. It should be noted that the drawings are not necessarily to scale. The foregoing and other objects, aspects, and advantages are better understood from the following detailed description of a preferred embodiment of the invention with reference to the drawings, in which.

DETAILED DESCRIPTION

Figure 1:
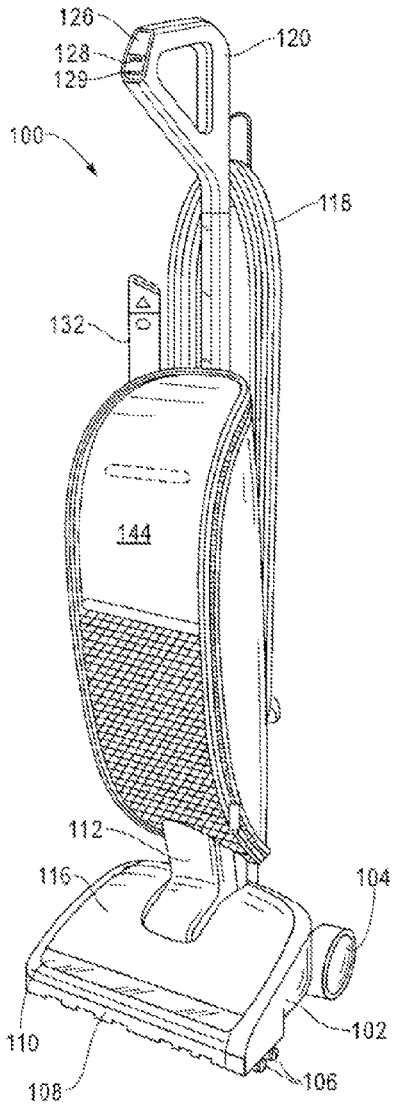
FIG. 1 illustrates a front prospective view of one embodiment of an upright vacuum cleaner.

The present teachings provide an upright vacuum cleaner including improved cleaning features. The essential structure of the vacuum comprises a handle, body, base, automated diverter valve and air duct including two input ports. An automated diverter valve assembly at the junction of the dirty air intake within the base extends the air duct within the base and connects to the main air duct of the vacuum to the beater bar input and an attachment input. The automated diverter valve causes the air intake of the vacuum to be drawn from either the beater bar (floor) air input or the attachment input. The main air duct is in air flow communication with a vacuum motor located in the body of the vacuum spaced from a distal end of the air duct with respect to the flow of air.

In some embodiments the vacuum cleaner comprises a servo assembly for moving the automated diverter from the beater bar input port to the attachment input port. In some embodiments the vacuum cleaner comprises a control board to operate the servo assembly in a desired rotational movement between the two input ports for a duration. In some embodiments the vacuum cleaner further comprises a signal from a user actuated switch, wherein the signal can be used by the control board to determine the valve position between the first input port and the second input port. In some embodiments the user actuated switch comprises a magnetic sensor disposed fixedly in the vacuum, and a magnet disposed in a rotatable portion of the vacuum, wherein placing the handle in a locked position rotates the rotatable portion, and disposes the magnet opposite the magnetic sensor. In some embodiments the diverter valve assembly comprises a vacuum attitude sensor, wherein a detection signal from the vacuum attitude sensor determines the valve position between the first input port and the second input port. In some embodiments the vacuum cleaner further comprises an attachment sensor signal to denote the absence of an attachment connected to the first input port, and the signal directs the control board to direct airflow from the second input port to the output port.

In some embodiments the servo assembly comprises a servo motor and a gear assembly, wherein the servo assembly is able to position the diverter as desired in two seconds or less. In some embodiments the diverter valve assembly includes detents to stop a movement of the automated diverter. In some embodiments, the rotatable scroll can be part of an upright vacuum cleaner in which the vacuum motor is located in the air path that contains dirt from a cleaning surface (sometimes referred to as a "dirty-air" type vacuum).

The result is an upright vacuum with significantly greater cleaning capability and ease of use. Since the diverter valve rotates between the beater bar input port and the attachment port automatically, an operator generally need not work as hard to utilize either the attachment or floor features of the vacuum. The diverter valve essentially seals the airflow path to direct air from only one input, thereby increasing the suction to any one input without suction loss from the other input port. Further, the vacuum cleaner need not shut the motor down when switching between beater bar and hand held use.

FIG. 1 is a perspective view of an exemplary embodiment of an upright vacuum cleaner 100. A handle 120 can be connected to base 102 via yoke 150 (see FIG. 9). Handle 120 can comprise aluminum. Wheels 104 can be disposed on yoke 150. Ergonomic aluminum handle 120 can include control buttons, such as power button 126, high speed setting button 128 and low speed setting button 129 for easy user controls of the vacuum cleaner. Bag assembly 144 can be connected to aluminum handle 120 via bag slide 130 (see FIG. 2). Base 102 can include a fascia 116. Further, fascia 116, scroll top cover 112, and scroll bottom cover 114 (see FIG. 2) can be made of different designs, textures and patterns in order to appeal to a user's preference or to individualize vacuum cleaners. Fascia 116 can be secured to the base 102 using means known in the art, for example, tabs (not shown) and slots (not shown) to receive the tabs. In some embodiments, scroll top cover 112 and scroll bottom cover 114 can comprise a fascia. Base 102 can further comprise side brushes 106, a bumper 108, and a light emitting diode (LED) strip 110 for improved cleaning capabilities of the upright vacuum cleaner unit. Vacuum 100 can include a power cord 118 and an extendible crevice tool 132.

Figure 2:
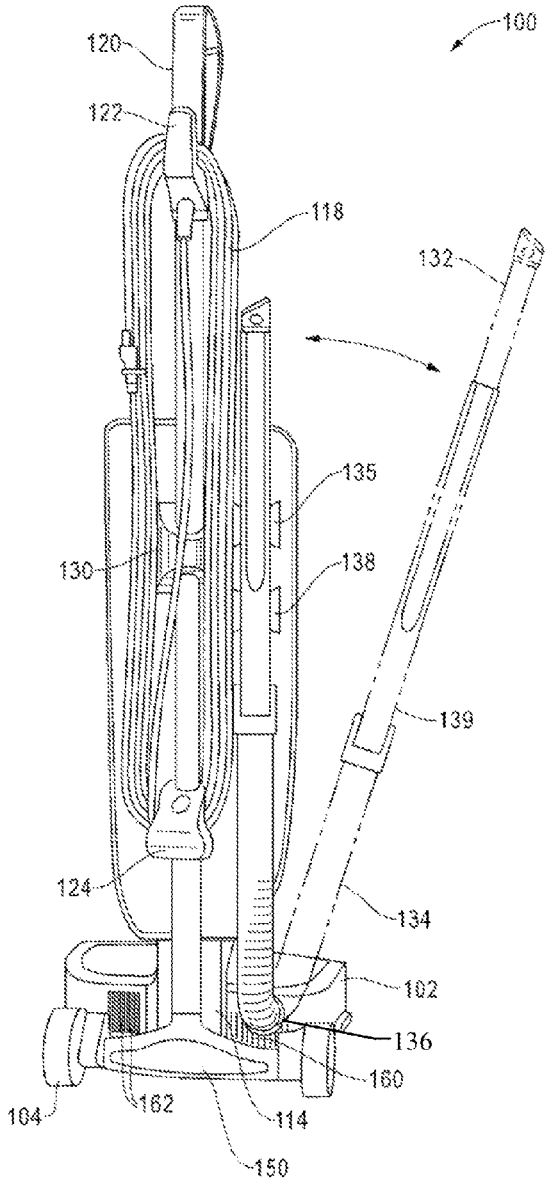
FIG. 2 illustrates the rear view of one embodiment of an upright vacuum cleaner.

FIG. 2 is a rear view of an exemplary embodiment of an upright vacuum cleaner 100. Power cord 118 can be connected to handle 120 and stored by top cord hook 122 and bottom cord hook 124 for easy storage and management. Base 102 can further comprise intake vent 160 for proper and adequate ventilation of any interior air flow propulsion devices. In one aspect of this embodiment, an exhaust vent 162 can be positioned adjacent the rear wheels 104. Accordingly, airflow drawn in from the intake vent 160 can be expelled from exhaust vent 162 and diffused over the surfaces of the rear wheel 104 as it leaves base 102. The diffusion can reduce the velocity of the airflow and reduce the likelihood that the airflow will stir up particulates on the floor surface. Base 102 can further comprise attachment hose input 136 for a hand held attachment. For example, one embodiment of a hand held attachment includes a flexible hose 134, a rigid hose 139 and an extendible crevice tool 132. In some embodiments, hand held attachments can include, but are not limited to brushes, squeegees, beater bars, extension hoses, nozzles, etc. In one embodiment, the upright vacuum cleaner comprises a tool caddy 138 for easy and convenient storage of a hand held attachment, for example, extendible crevice tool 132. A tool holder 135 can be disposed on bag assembly 144. Tool holder 135 can friction fit around extendible crevice tool 132 for easy storage and management of flexible hose 134, rigid hose 139 and extendible crevice tool 132. Extendible crevice tool 132 can be removed from tool holder 135 for use.

Figure 3:
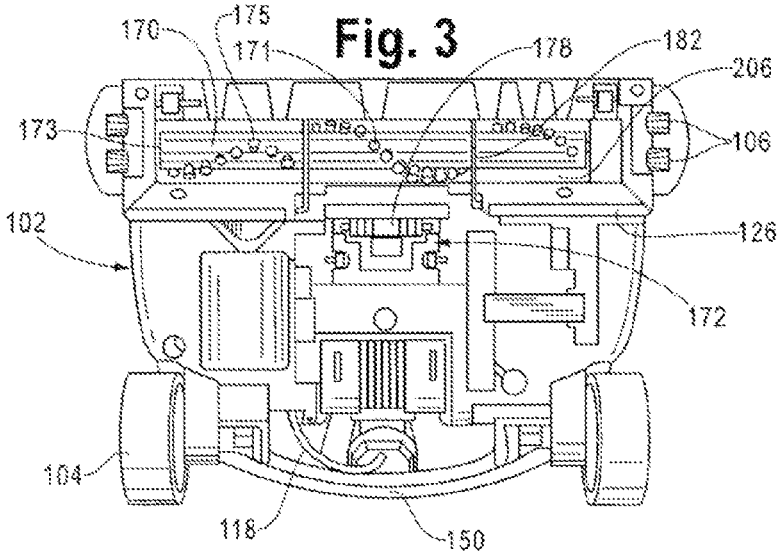
FIG. 3 illustrates the bottom of the base of an upright vacuum cleaner according to one embodiment.
Figure 5:
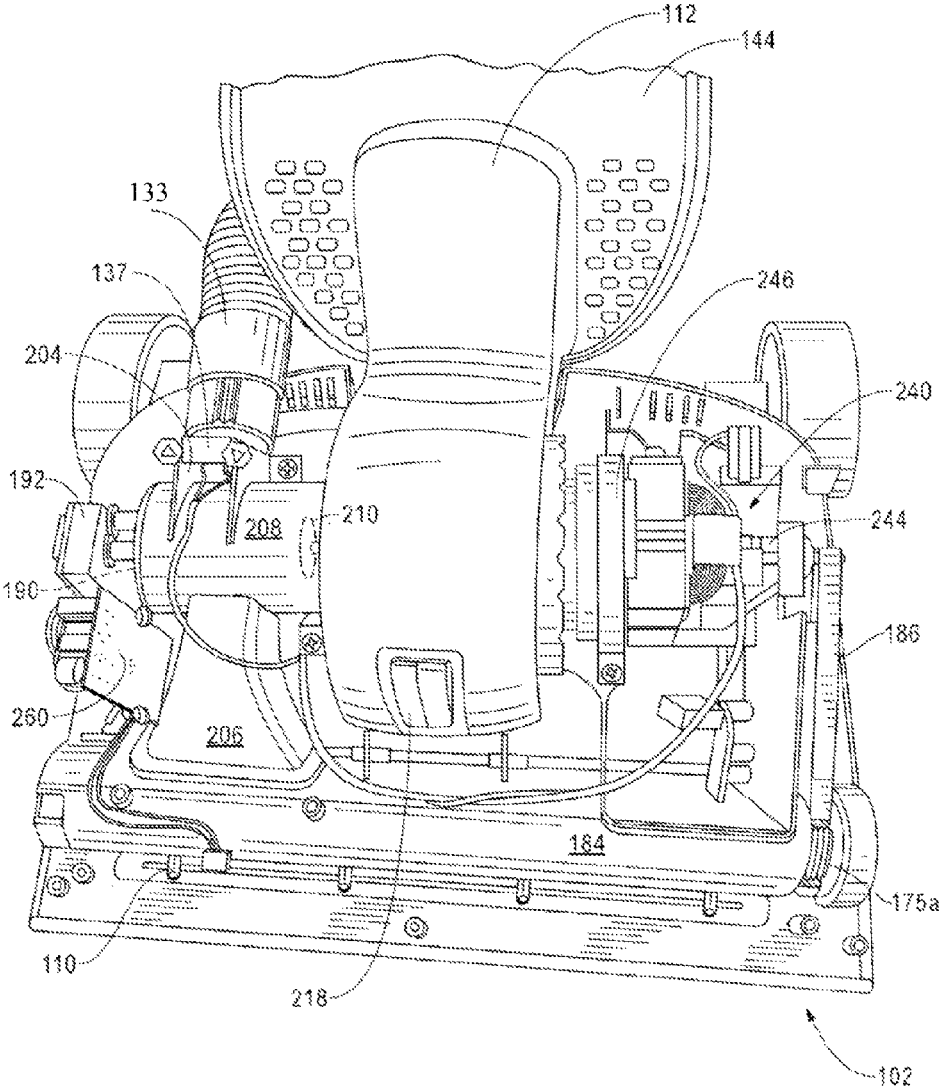
FIG. 5 illustrates the interior of the base of an upright vacuum cleaner according to one embodiment.

FIG. 3 is a bottom view of an exemplary embodiment of an upright vacuum cleaner 100. Base 102 is supported by wheels 104 and front wheel 178. Base 102 generally hovers over a cleaning surface, such as a floor. Base 102 can contact a cleaning surface, for example, when the cleaning surface is a deep shag carpet. Agitation devices, such as a beater bar 170, squeegees 126, and side brushes 106 can provide agitation of cleaning surfaces in order to dislodge and direct debris into floor air intake port 206 (not shown). Beater bar 170 can be driven by a motor assembly 240 (see FIG. 5) via a flexible belt 186 (see FIG. 5) or other mechanism. Anti-ingestion bars 182 prevent large sized items from being drawn into the floor air intake. Beater bar 170 can include a spindle 175 and an arrangement of bristle tufts 171 that sweep the particulates into the air intake port 206 (see FIG. 3). As seen in FIG. 5, a belt receiver 175*a* can be disposed on spindle 175. Belt receiver 175*a* can include grooves to receive corresponding grooves disposed in belt 186. Bristle tufts 171 can be arranged on beater bar in many different orientations. The fibers of the bristles can be of substantially identical stiffness, diameter and geometry or of different stiffnesses, diameters and geometries as desired. The fibers of the bristles can be made of natural or synthetic materials, or combinations thereof, including but not limited to nylon, plastic, polymers, rubber, hair (e.g., boar's hair). In one embodiment, bristles can be arranged in a double helix pattern.

In a preferred embodiment, the bristle tufts can be arranged in a single helix or helical row. The single helical row can reverse its direction of rotation, e.g., at bristle tuft 173 in FIG. 3. The single helical row can reverse its direction of rotation after about one and a half turns about spindle 175. The average length of the fibers of the bristle tufts can be from about 0.300 inches to about 0.500 inches. The average diameter of the fibers of the bristle tufts can be from about 0.008 inches to about 0.015 inches. Additionally, the bristle tufts can be angled out or placed non-orthogonally from the spindle to maximize the "embedded dirt" movement characteristics of the vacuum. The bristle tufts can be offset from the centerline about 0.08 inches to about 0.15 inches. In a preferred embodiment, the bristle tufts can comprise filaments comprising Nylon 6-6. The mean diameter of each filament can be about 0.012 inches. The mean amplitude of each filament can be about 0.022 inches. The mean tuft length of each filament can be about 0.370 inches. The tuft offset from centerline can be about 0.120 inches. In some embodiments, a single helix brush can be advantageously used in high shag carpets as its rotational speed is not inhibited to the same degree as the rotational speed of double helix brushroll. In embedded dirt cleaning performance tests, a single helix brushroll as described above can remove about 15% more dirt than the prior art double helix brushroll.

Figure 4:
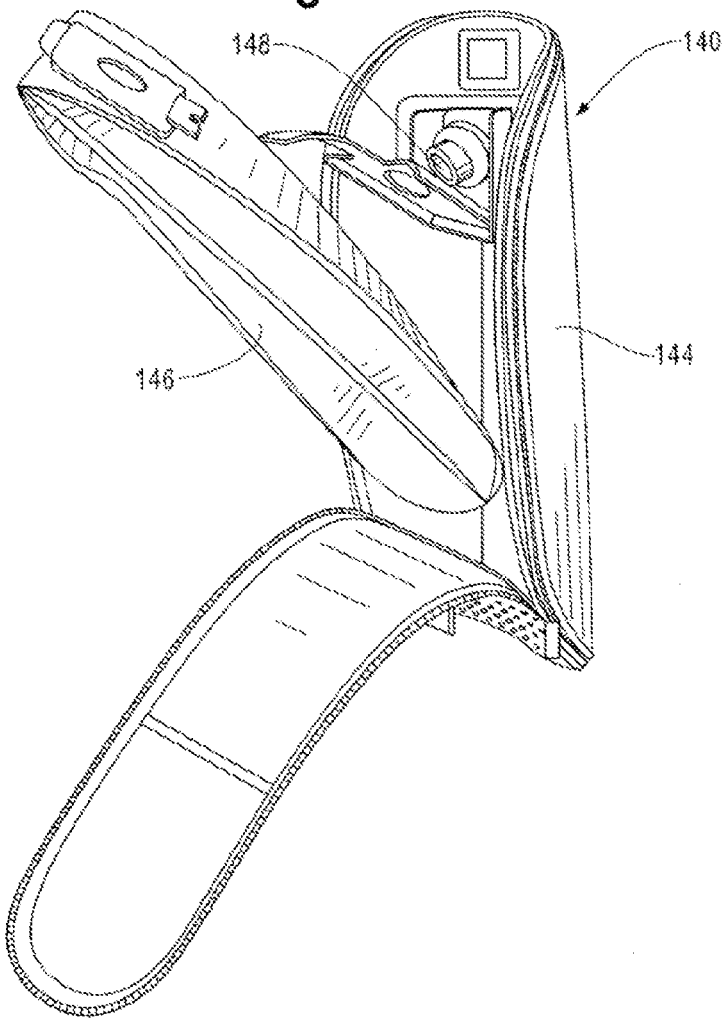
FIG. 4 illustrates the bag assembly of a debris capturing device of an upright vacuum cleaner according to one embodiment.

FIG. 4 is a bag assembly 140 of an exemplary embodiment. A debris collection device 146 is disposed in outer bag 144. Debris collection device 146 can be connected to a dirty air inlet 148 to collect and trap and filter debris taken into the vacuum. In one embodiment, debris collection device 146 can be a disposable bag. In another embodiment debris collection device 146 can be a reusable bag. In another embodiment debris collection device can be a reusable canister or container. Bag assembly 140 can optionally further include a variety of filters for cleaning dirty air. Such filters can include one or more wire, mesh, carbon, activated charcoal, or HEPA filters.

FIG. 5 is an interior view of an exemplary embodiment of base 102. Beater bar housing 184 can be connected to the dirty air path via a diverter valve assembly 190 at input port 206. Automated diverter valve assembly can also contain a second input port 204. A connector 133 can connect to input port 204. A hose and attachments can be connected to connector 133. Airflow can be directed from either input port 206 or input port 204 to output port 208. Servo assembly 192 can rotationally direct an automated diverter or diverter valve 212 (see FIG. 7A and 7B) into a scroll/volute 218 (only a small portion is visible in FIG. 5). Airflow can be generated by motor assembly 240 which draws air in from either input port 206 or input port 204 and out through rotatable scroll 218 into bag assembly 144 where debris can be contained. An impeller 226 (see FIG. 8A) is driven by the motor shaft and is housed in scroll 218. Motor assembly 240 can drive beater bar 170 via a flexible belt 186. In some embodiments, flexible belts of the instant invention can exceed the mean time between failure (MTBF) of the vacuum cleaner itself. Thus, flexible belts may never have to be replaced during the lifetime of the vacuum. In some embodiments, the belts are circular belts or serpentine belts. In some embodiments the belt can include a flat or length-wise grooved surface. If the belt includes a grooved surface, the surface can include 1, 2, 3, 4, 5 or more grooves. The belts can be made of materials known in the art, including, but not limited to rubber, nylon, plastics, and polymers such as polybutadiene, and polyamide, among others. In one embodiment, the belt can be provided by Hutchinson FTS of Troy Michigan. Motor assembly 240 can comprise an end cap 246 that houses fan 250 (not shown) and motor 248.

Circuit board 260 of FIG. 5 can provide electrical current to motor assembly 240, an LED light assembly 110, servo assembly 192, and an attachment sensor 137. Attachment sensor 137 can comprise a contact switch which is depressed when connector 133 is disposed about input port 204. A signal from attachment sensor 137 can be used by circuit board 260 prior to positioning diverter valve assembly 190 to select input port 204. In other words, if connector 133 is not in place, a user cannot inadvertently be injured by the suction created at input port 204. Circuit board 260 can also provide electrical current to various other components of the vacuum cleaner, such as motorized beater bars, motorized handheld attachments, temperature sensors, attitude sensors, magnetic sensors, indicator lights, etc.

Figure 6:
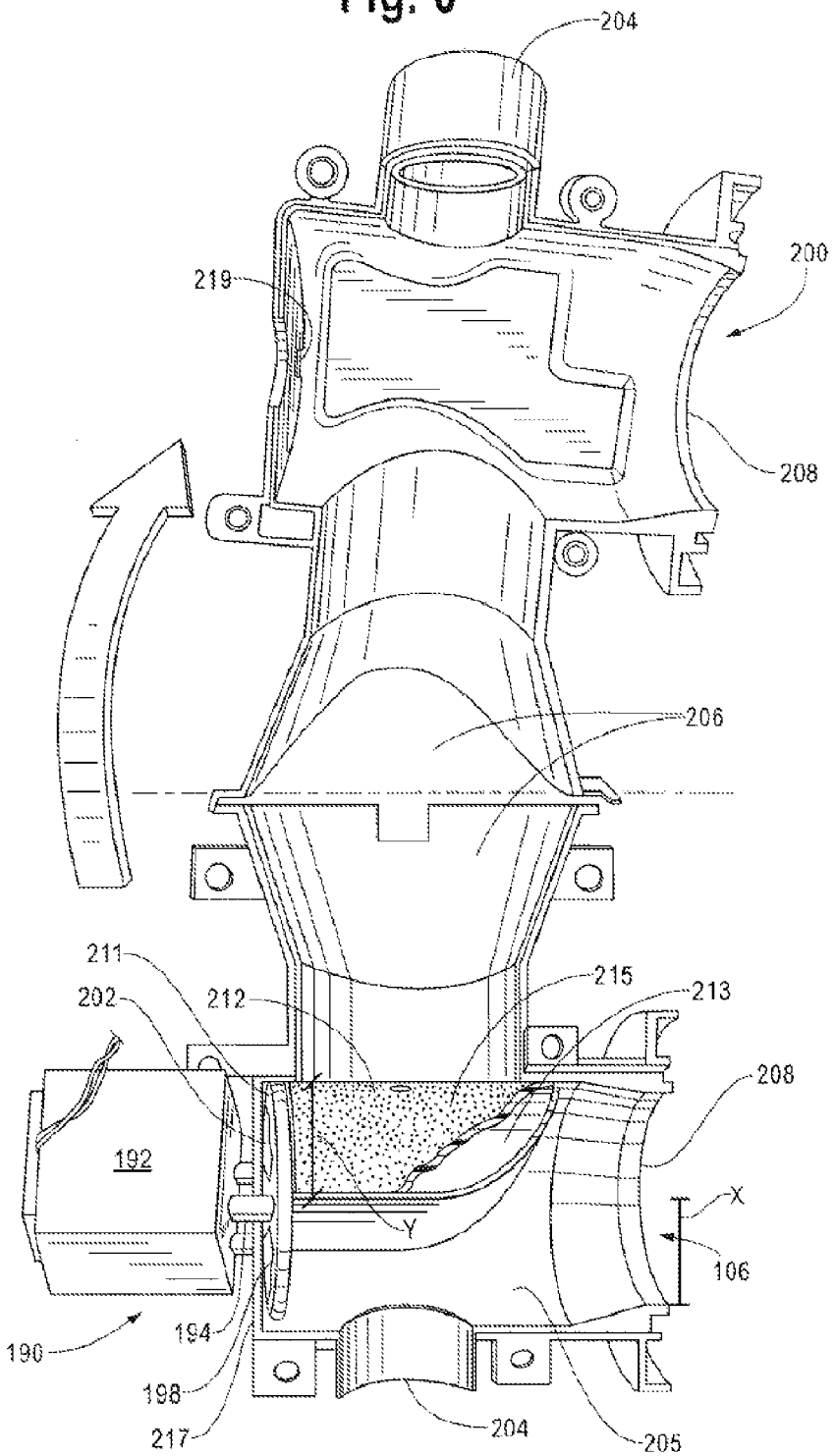
FIG. 6 illustrates an automated diverter valve assembly of an upright vacuum cleaner according to one embodiment.

FIG. 6 is an interior view of an exemplary embodiment of diverter valve assembly 190. Diverter valve assembly 190 can be assembled with assembly housing top 106 and assembly housing bottom 108. When assembly housing top 106 and assembly housing bottom 108 are attached, the assembly can define input port 204, input port 206 opposite input port 204, and output port 208. Servo assembly 192 can be disposed opposite output port 208. A diverter valve 212 can be fixedly attached to servo assembly 192. Airflow can be directed from either input port 206 or input port 204 by servo assembly 192 by rotating automated diverter valve 212 to block either input port 204 or input port 206. Diverter valve assembly can comprise a cylindrical conduit 205 having a radius X that is slightly greater than a radius Y of automated diverter valve 212. Automated diverter valve 212 can comprise a cylindrical portion.

In some embodiments automated diverter valve 192 includes detents to stop its movement. For example, diverter valve 212 can include diverter valve detents 198 and 202, where a wall of diverter valve 212 forms a ridge. A wall 211 of diverter valve 212 can be placed adjacent to a wall 217 of the diverter valve assembly against which servo assembly 192 is secured; this wall can a include bump-out 219 (see FIG. 6) to stop the travel of diverter valve 212 against detents 198 and 202. As such, detents 198 and 202 define a range of motion for diverter valve 212.

In some embodiments, diverter valve 212 includes a low friction film 215 and a protective valve sheathing 213 deposed underneath. Protective valve sheathing 213 aids in sealing the diverter valve 212 over input port 206 or 204 as selected. Low friction film 215 allows diverter valve 212 to easily rotate between input port 206 and 204. Protective valve sheathing 213 can be manufactured from, without limitation to, plastic, foam, felt, plastic or other suitable materials, or combinations therein. Low friction film 215 can be smooth film.

Figure 7A:
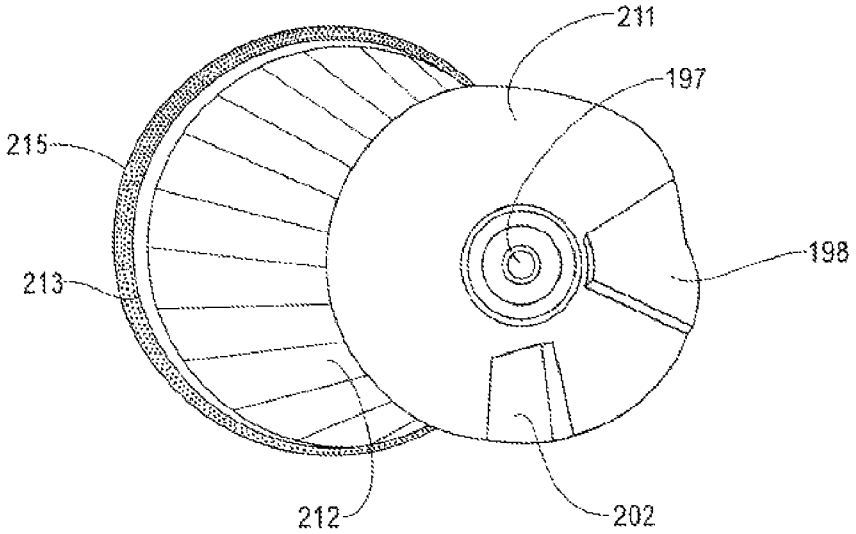
FIGS. 7A and 7B illustrate an automated diverter valve and motor assembly of an upright vacuum cleaner according to one embodiment.
Figure 7B:
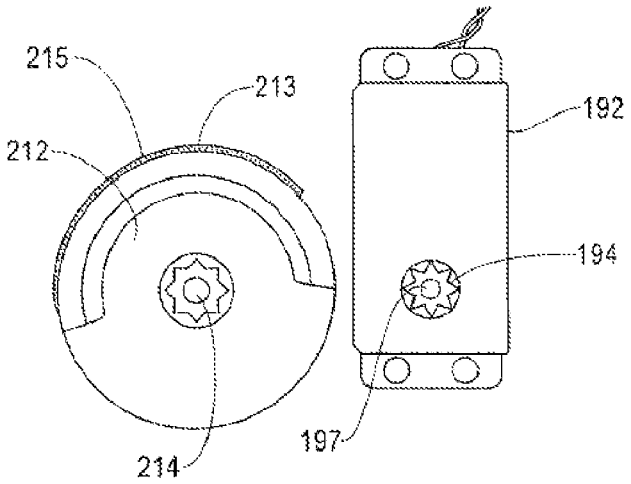

As seen in FIGS. 7A and 7B servo assembly 192 can drive diverter valve 212 through servo motor shaft 194 which can be fastened to diverter valve shaft aperture 214 by fastener 195. The servo motor shaft 194 can be keyed to provide precision of movement. Servo assembly 192 can comprise a servo motor (not shown) and a gear assembly (not shown) that can rotate diverter valve into position using a desired speed and torque. Such speeds can include whole or fractions of a second. For example, the motor can be designed such that the diverter valve can be rotated from one input port to the other within or less than one-half, one, two, three, five or more seconds. Diverter valve 212 can comprise a shaft aperture 214 through which a fastener, for example, a screw, can be secured to a servo shaft aperture 197.

Figure 8A:
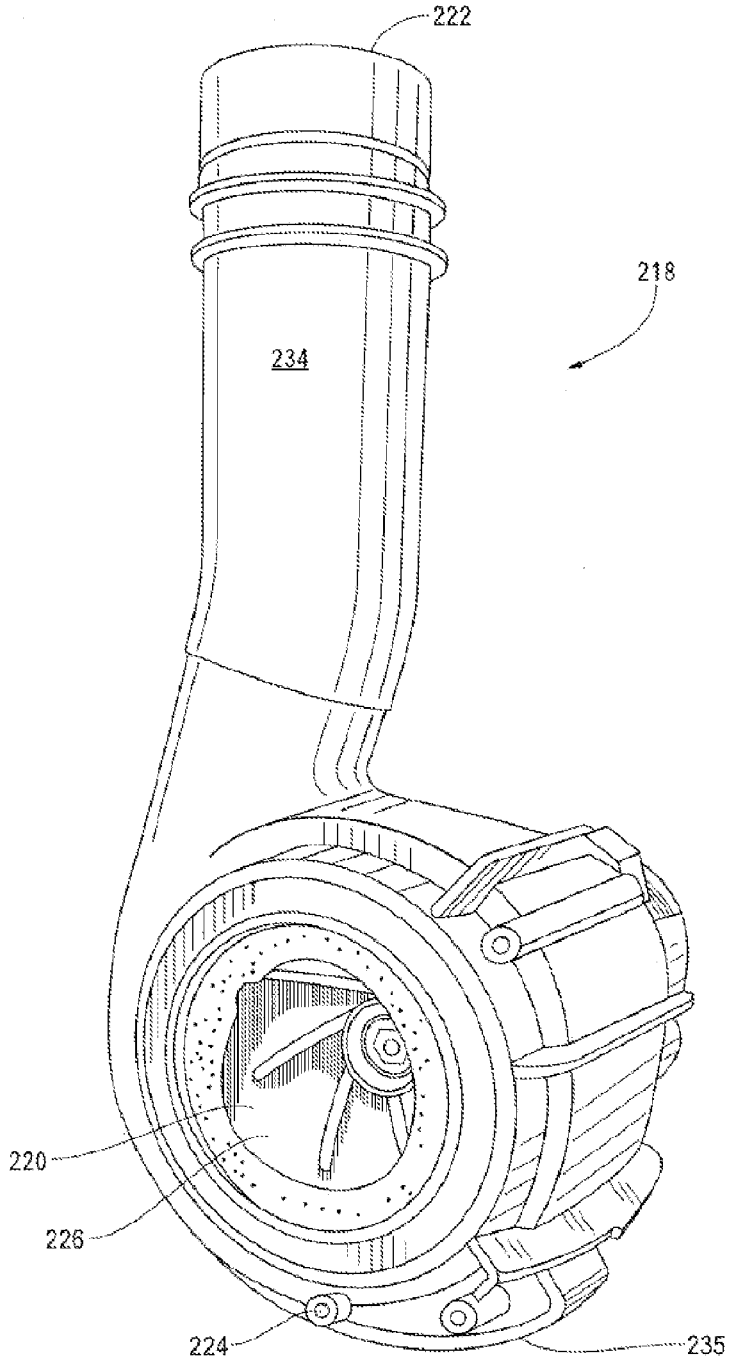
FIGS. 8A and 8B illustrate one embodiment of a scroll of an upright vacuum cleaner according to one embodiment.

FIG. 8A is an illustration of an exemplary embodiment of a scroll 218. Airflow for the upright vacuum can be generated via impeller 226. Impeller 226 can be driven by motor assembly 240. Impeller 226 draws air in from automated diverter valve assembly 190 via air intake 220. The drawn air is sent via an air conduit 234 into air output 222. Air output 222 can be connected via conduit 219 (see FIG. 12) to bag assembly 144 where debris can be contained for discard. Conduit 219 can be removable to allow a user to remove air flow obstructions from conduit 219 and/or scroll 218. Scroll 218 and air conduit 234 can include a cross-sectional area progression from dirty air intake 220 to the air output 222 that smoothly varies between the first cross-sectional area and the second cross-sectional area. Because the intake passage includes a smoothly varying area progression, turbulence within the intake passage may be reduced or inhibited, and noise generated by the airstream within the intake can be minimized. Scroll 218 can also comprise ramp 235.

In some embodiments, scroll 218 comprises a magnet 224. A magnetic sensor 210 (see FIG. 5) can be disposed fixedly in vacuum base 102. Magnet 224 is disposed opposite magnetic sensor 210 when scroll 218 is rotated to a predetermined position, for example, when handle 120 is placed in a locked position. In some embodiments magnetic sensor 210 can be located adjacent, e.g., below, diverter valve assembly 190. Magnetic sensor can determine an attitude of vacuum base 102, e.g., is the vacuum at rest, is the vacuum handle locked, or is the vacuum handle unlocked. Further, in some embodiments a signal generated from the magnetic sensor 210 can determine diverter valve 212 position between first input port 204 and second input port 206. In one embodiment, magnetic sensor 210 is disposed beneath output port 208. Magnetic sensor 210 is fixed to vacuum base 102.

Figure 8B:
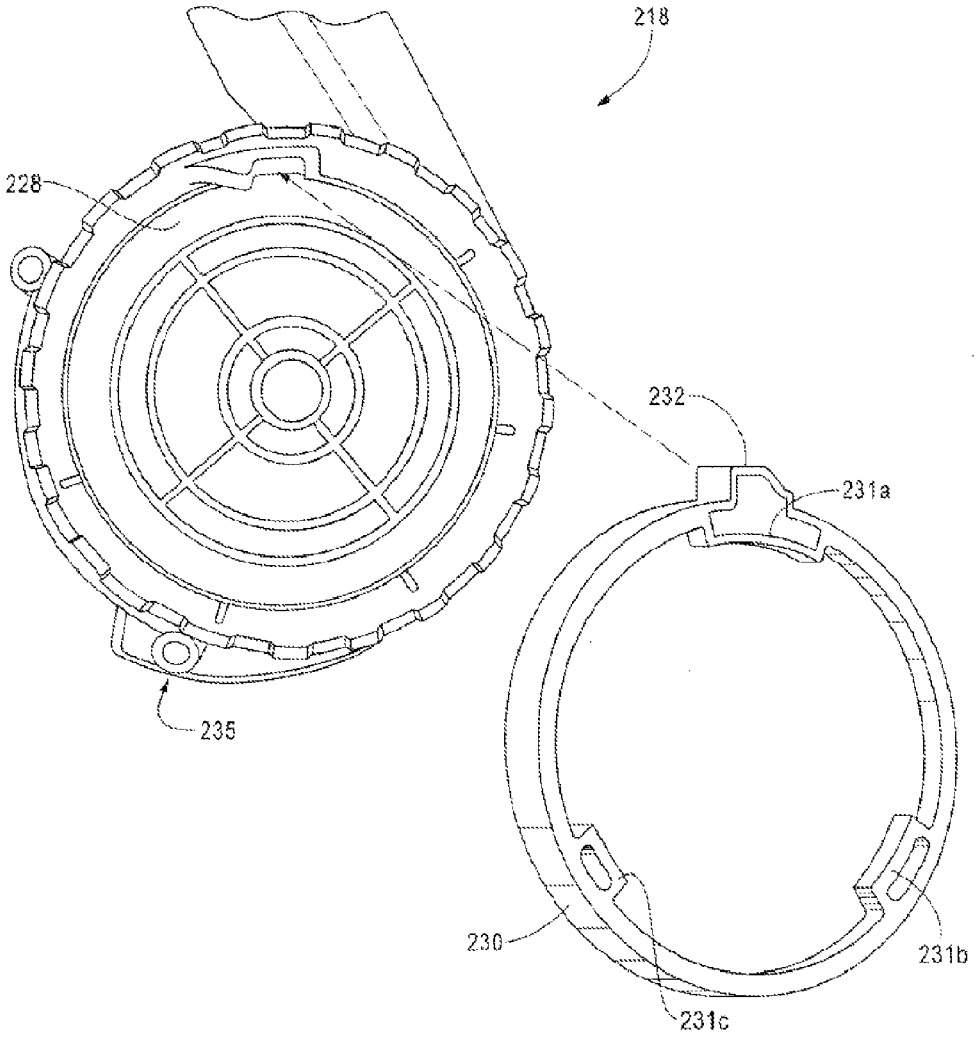

FIG. 8B is an illustration of an exemplary embodiment of a scroll. Scroll 218 includes scroll ring receiving groove 228 to receive scroll ring 230. When scroll ring 230 is disposed within scroll ring receiving groove 228, scroll ring tab 232 clicks into place and locks scroll 218 into a locked upright position. Scroll 218 is locked in position by forming a friction fit of scroll ring tab 232 against an inner wall of scroll ring receiving groove 228 disposed in scroll 218. When scroll 218 is locked, rotation of handle 218 about yoke axle 151 (see FIG. 10) is also inhibited. In some embodiments, scroll ring 230 allows for a rotation of about 90 degrees to 120 degrees for scroll 218. This translates into a similar rotation of about 90 degrees to 120 degrees about yoke axle 151 for handle 120.

Scroll ring 230 is disposed about motor housing cap 246. Key tabs 231*a*, 231*b*, and 231*c* are received by motor housing cap 246 to properly orient scroll ring 230 and scroll ring tab 232. Motor assembly 240 is fixedly disposed in base 102. As such, scroll ring 230 is fixedly disposed in base 102, i.e., scroll ring 230 does not rotate. However, scroll 218 rotates about scroll ring 232 so that handle 120 can rotate. Rotation of scroll 218 causes bag slide (see FIG. 2) to move up and down on handle 120 as needed.

Figure 9:
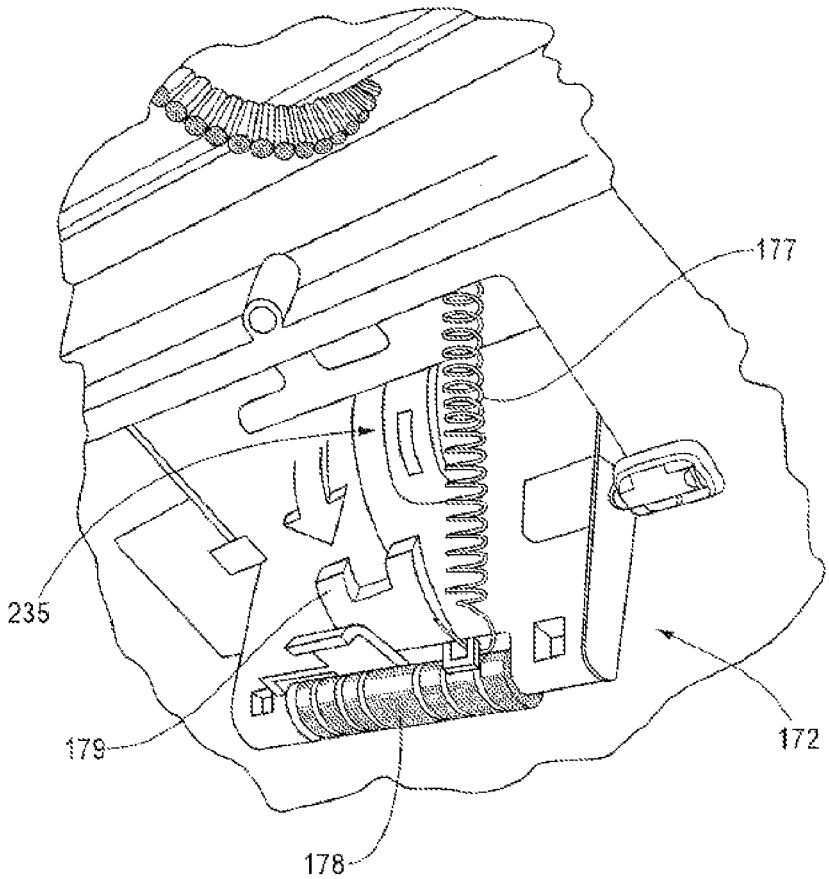
FIG. 9 illustrates a lifting assembly of an upright vacuum cleaner according to one embodiment.

FIG. 9 is an exemplary embodiment of a lifting mechanism. In some embodiments, when handle 120 is placed in a locked upright position, scroll 218 is rotated such that ramp 235 (see FIG. 8A) contacts lift tabs 179 of lifting assembly 172. When ramp 235 pushes against lift tabs 179, lifting assembly 172 including front wheel 178 protrude out from base 102. This causes base 102 to be raised off of a cleaning surface. In the absence of ramp 235 pushing on lift tab 177, a biasing device 177, e.g., a spring, keeps lifting assembly 172 pulled into base 102. By pushing lifting base 102 against a cleaning surface the vacuum ceases to agitate the cleaning surface. This can prevent unnecessary dust and debris from being generated by the rotation of the beater bar 170, side brushes 106 or squeegee 176. Moreover, by raising the beater bar a load on the motor is reduced. This can reduce the wear and tear on the motor, the belt and the beater bar.

Figure 10:
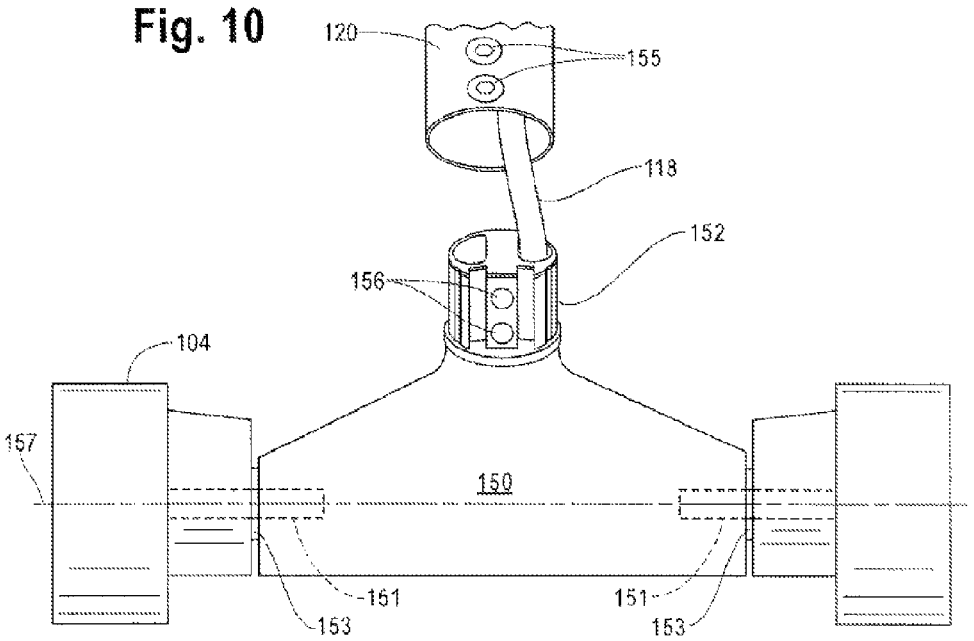
FIG. 10 illustrates an exploded view of a yoke assembly of an upright vacuum cleaner according to one embodiment.

FIG. 10 is an exemplary embodiment of a yoke assembly. As seen in FIGS. 1 and 2, yoke 150 and handle 120 are distinct from scroll 218 and bag assembly 144. In one embodiment, yoke assembly 150 can he connected to handle 120. In some embodiments, handle insert 152 is inserted into hollow handle 120. Handle 120 can be secured to yoke 150 via fasteners (not shown). The fasteners can pass through fastener apertures 155 and be fastened to fastener receiving apertures 156. Fasteners can include screws, tension clips, etc. Yoke assembly 150 can be divided by handle insert 152. Handle insert 152 can include two internal housings within yoke assembly for passing a power cord 118 therethrough. Advantageously, providing a distinct compartment and path for power cord 118 within yoke assembly 150 protects power cord from damage from with fasteners or handle 120. Yoke assembly axles 151 and washers 153 can connect yoke 150 to wheels 104. Advantageously, because yoke assembly 150 and handle 120 are distinct from base 102 and scroll 218, yoke assembly 150 can provide a moment arm 157 anterior to base 102. Moment arm 157 can be co-linear with yoke axle 151. In some embodiments, yoke axle 151 can comprise a single rod secured to yoke 150. In some embodiments, yoke axle 151 can comprise two rods secured to yoke 150. Yoke axle 151 can be secured to yoke 150 via C-rings 153. It is theorized that with an anterior moment arm, a force applied to handle 120 causes yoke assembly 150 to be pushed towards a cleaning surface rather than pushing base 102 towards the cleaning surface. As such, any downward component of the force applied to handle 120 does not push base 102 down also. This reduces a frictional force of base 102 against the cleaning surface. The resulting reduction in friction provides a much easier vacuum to push and control for a user over a cleaning surface, and provides a "floating head."

Figure 11:
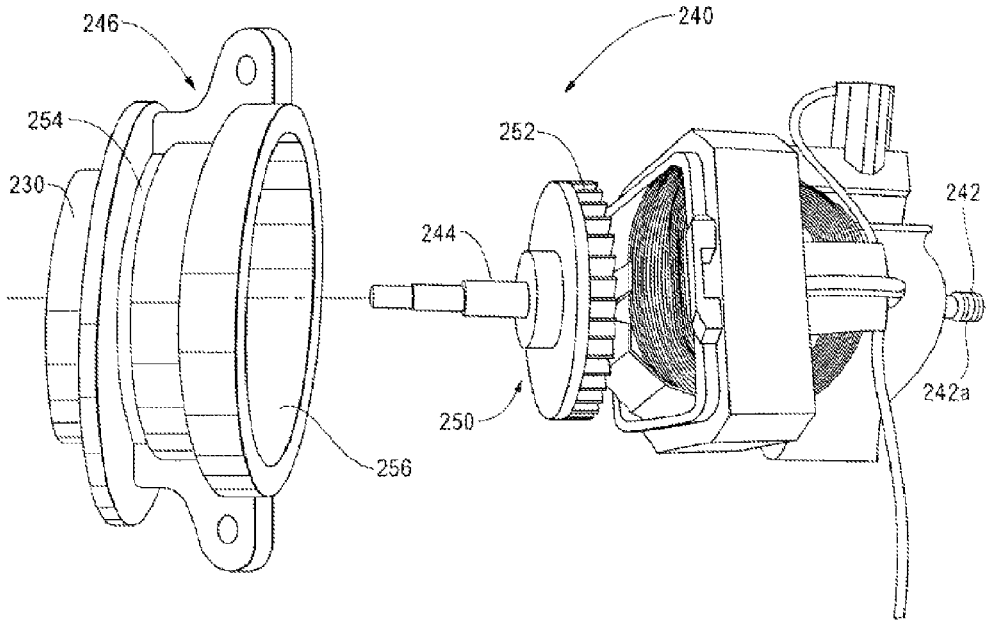
FIG. 11 illustrates an exploded view of a motor assembly of an upright vacuum cleaner according to one embodiment.

FIG. 11 is an exemplary embodiment of a motor assembly. Motor assembly 240 can provide air flow for a vacuum cleaner. In one embodiment a shaft of motor assembly 240 can protrude from both ends of motor assembly 240. Shaft portion 244 can rotate a fan (see FIG. 8A), such as an impeller, housed within scroll 218 to generate air flow. Shaft portion 242 can turn drive belt 186 and rotate beater bar 170. The outer surfaces of shaft portions 242 or 244 can be smooth, flat, textured, keyed or may include one, two, three or more grooves 242a as desired. Motor assembly cap 246, located on the distal end of motor assembly 240, can provide protection for fan 250, while further defining an air inlet 245 and an air outlet 256. The motor assembly cap 246 can propel air over motor assembly 240 disposed within base 102. Advantageously, air flow generated by fan 250 exiting air outlet 256 can cool heat generated by motor assembly 240, thereby allowing a vacuum to utilize a larger motor than found in prior art vacuums.

Figure 12:
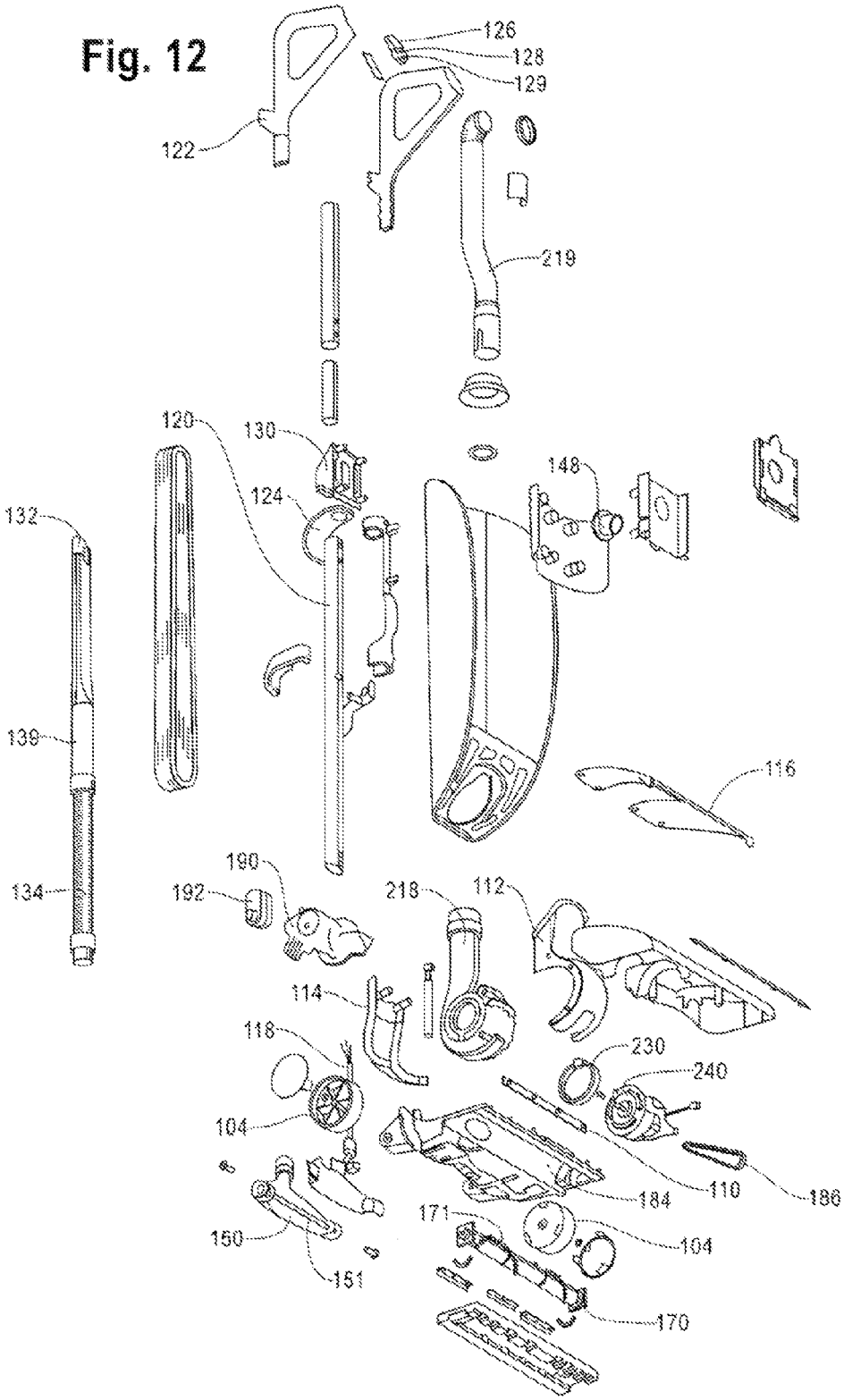
FIG. 12 illustrates an exploded view of an upright vacuum cleaner according to one embodiment.

Base 102 can be an airtight chamber. As seen in FIG. 12, base 102 can be assembled from base top 164 and base bottom 165, which are held together by fasteners 166. Base 102 can be sealed by gasket 167 situated between base top 164 and base bottom 165. Gasket 167 can be made from any suitable material, including but not limited to paper, rubber, silicone, metal, cork, felt, neoprene, nitrile rubber, fiberglass, or a plastic polymer (such as polychlorotrifluoroethylene) or any combination thereof. Motor assembly 240 can draw air to cool the operating parts of the vacuum via air vent 160. The drawn air can be exhausted via air vent 162. Air vent 160 and air vent 162 can define an air path through base 102. The air path can be a straight or convoluted path. The high volume of airflow produced by fan 250 allows the placement of a high powered motor in base 102. The high CFM also permits cooling of components in the base even when no particular airflow path is defined within the base. For example, airflow generated by fan 250 can be circulated throughout base 102 by placing air intake vent 160 along the same wall as air vent 162. Other configurations for disposing the air intake and air exhaust in the base can be used.

Centrifugal fan 250 can include multiple fan blades and a hub. Centrifugal fan blades can have a slight backward curve. Alternatively, the fan can be axial or squirrel cage fans, or other material handling fans. In some embodiments, fan 250 can be made of one or more of a combination of materials, including metals, such as aluminum or plastic. In some embodiments fan 250 can be a centrifugal fan with a slight backward curve including 30 blades made by injection molding. In some embodiments, fan 250 can generate a blade pass frequency (BPF) that is greater than the BPF of prior art fans. The fan BPF noise level intensity varies with the number of blades and the rotation speed and can be expressed as BPF=n*t 160, where BPF=Blade Pass Frequency (Hertz (Hz)), n=rotation velocity (rpm), and the number of blades. In noise profiles of a fan, high-amplitude spikes are observed at the BPF and at the harmonics of the BPF. Humans perceive sound frequencies ranging from 20 to 15,000 Hz. Moreover, sounds between 2,000 to 4,000 Hz are often perceived as very irritating and annoying to humans.

Figure 13A:
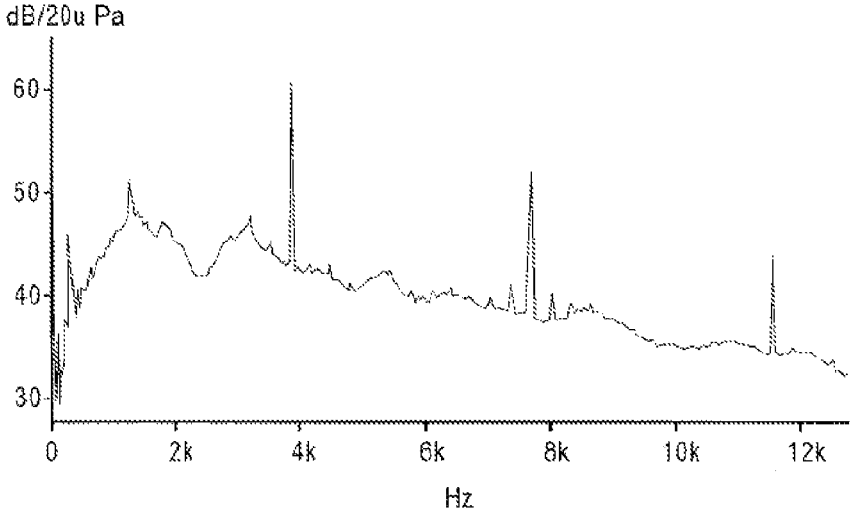
Fig. 13A Prior Art
FIG. 13A illustrates sound data generated by a prior art cooling fan blade.

Prior art fans for motors used in vacuums generally use a stamped radial fan blade, a fan with blades extending out from the center along radii, usually comprising 2-12 blades. For example, in the prior art a vacuum motor having a 12-blade fan and operating at about 20,000 RPM would have a calculated BPF of about 4000 Hz. As can be seen in FIG. 13A, the noise data profile for this prior art cooling fan produced decibel spikes over 50 dB/20 u Pa at approximately 4,000 Hz. At 50 dB/20 u Pa, the prior art fan's noise profile spike is about 20 dB greater than the noise observed immediately around the 4000 Hz spike frequency. The spike at about 4000 Hz is within the annoying and irritating noise range for humans. Furthermore, harmonic frequencies of the BPF within a human's average hearing range, e.g., 8000 and 12000 Hz, also produce large noise peaks.

By using a fan with a greater number of blades, the BPF can be manipulated to fall outside a desired sound frequency band. For example, the fan can comprise 20, 22, 24, 26, 28, 30, 32, 34, 36, 38, 40 or more blades. A further advantage is that the unique design of motor assembly 240 and blade 250 includes a bigger blade surface area. Furthermore, this increase in blade area coupled with the greater number of blades in the fan can generate a greater airflow. The greater airflow can by generated by a motor assembly cap having the same or less volume than a motor assembly cap housing of prior art. By manipulating the number of blades and the RPMs of the fan, the BPF can be adjusted to spike at a frequency greater than about 5000, 5500, 6000, 6500, 7000, 7500, 8000, 8500, 9000, 9500, 10,000 or more Hz. A change in the blade pass frequency of the fan provides a reduction in perceived motor and fan noise. In some embodiments, the noise spikes generated by the fan is selected such that a BPF spike is outside a human ear's irritation noise range. Further in some embodiments, a BPF spike is generated outside of a human ear's audible noise range. In some embodiments motor assembly 240 can operate at about 10,000 to about 20,000 rotations per minute (RPM). In some embodiments assembly 240 can operate at about 10,000 or about 20,000 RPM. In some embodiments assembly 240 can operate at about 13,000 or about 18,000 RPM.

Figure 13B:
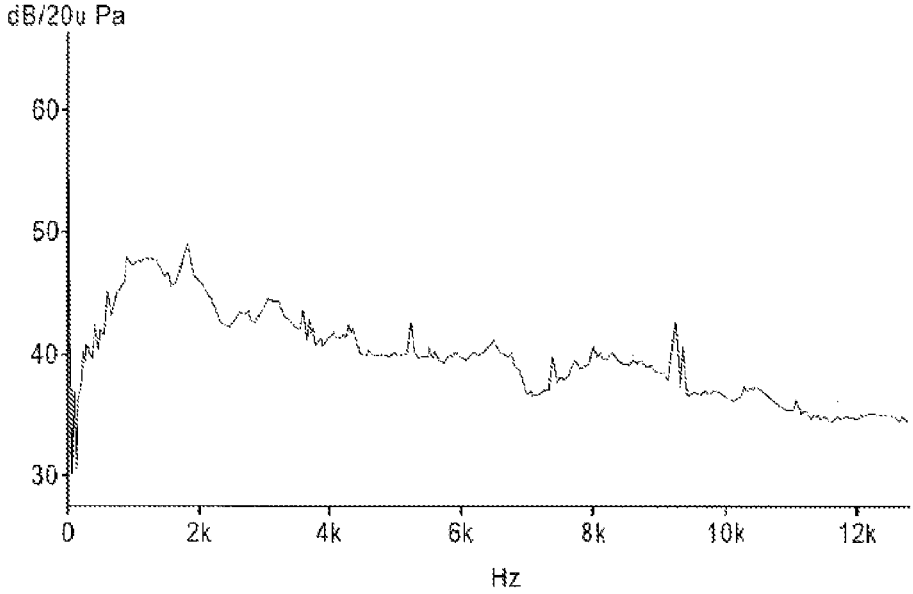
FIG. 13B illustrates sound data generated by a cooling fan according to one embodiment.

As seen in FIG. 13B, the BPF of fan 250 of the present vacuum is about 9000 Hz, when the fan is rotated at about 18000. Furthermore, a switch to centrifugal fans from the radial fans of the produce reduces the amplitude of the spike at the BPF. The spike at 9000 Hz is only about 4 dB/20 u Pa greater than the noise observed immediately around the 9000 Hz spike frequency. The use of the centrifugal also lowers the acoustic characteristic of noise at the BPF by an order of 5.

Vacuum cleaner 100 can be capable of detecting blockage along an airpath of vacuum 100 by determining the amperage flow of the electrical current, and detecting blockage along an airpath by sampling the amperage flow of the electrical current and counting how many times the sampled amperage draw exceeds a threshold amperage within a window of time. When the samples sampled exceeds the percent threshold determined, power to motor assembly 240 is terminated. Optionally, an indicator light can be illuminated when power is shut-off. After receiving a reset signal the current flow to the motor can be restored.

Figure 14:
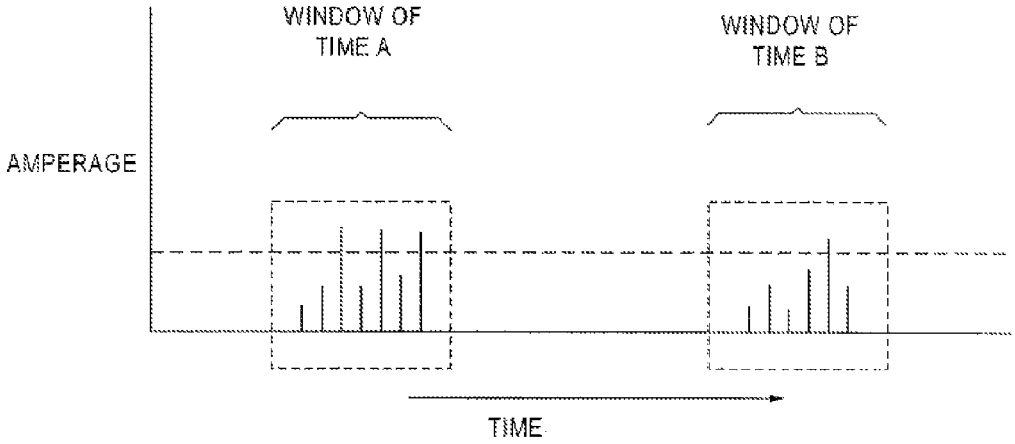
FIG. 14 illustrates a graph of the amperage draw of a motor in a window of a selected duration according to one embodiment.

FIG. 14 illustrates a graph of the amperage draw of a motor in a window of a selected duration of an upright vacuum cleaner. Circuit board 260 can provide electrical current to motor assembly 240. Measurements of current drawn by vacuum motor can determine whether there is blockage with the vacuum air duct or beater bar. Depending upon the severity of the blockage, circuit board 260 can shut off power to motor assembly 240. For example, circuit board 260 can comprise an amperage flow sensor (not shown) to determine or measure the electrical current draw of motor assembly 240. Circuit board 260 can also comprise a blockage determiner 262 to sample the electrical current draw with the amperage flow sensor and count the number of times the sampled electrical current draw exceeds a threshold amperage within a sliding window of time. As seen in FIG. 14, the sliding window of time period or duration A illustrates that circuit board 260 counted three (3) instances or samples out of seven (7) instances where the current draw of the motor exceeded a threshold amperage (shown as the dashed line parallel to the horizontal axis). As such, during time period A about 43% (3/7*100) of samples exceeded the threshold amperage. In contrast, circuit board 260 counted only one (1) instance out of seven (7) for time period B where the current draw of the motor exceeded the threshold amperage. Windows A and B can overlap along the time (horizontal) axis. In some embodiments the blockage determiner can signal that upright vacuum cleaner 100 is experiencing blockage when the count exceeds a desired percentage of samples sampled in the window of time. In some embodiments, the desired percentage is at least 10, 20, 30, 40, 50 or more of the samples sampled in the window of time. In some embodiments, blockage determiner 262 samples the amperage draw 15, 30, 60, or 90 times a second or more. In some embodiments the sliding window of time 264 is greater than or equal to 5, 10, 15, 20, 30, 45, 60, 90, or 120 seconds.

Vacuum cleaner 100 and circuit board 260 can comprise multiple sensors and switches. In a broad sense, a "sensor" as used herein, is a device capable of receiving a signal or stimulus (electrical, temperature, time, etc.) and responds to it in a specific manner (opens or closes a circuit, etc.). A "switch," as used herein, can be a mechanical or electrical device for making or breaking or changing the connections in a circuit. In some embodiments sensors can be switches. In other embodiments the sensors are connected to indicator lights or the like to inform a user of a malfunction or the need to perform a necessary function. Vacuum cleaner 100 or circuit board 260 can comprise flow blockage, light, temperature, "bag full" sensors, and handle attitude sensors. Signals from these sensors can aid the user in using and assessing various states of the vacuum. Sensors can comprise electric, magnetic, optical, gravity, etc., sensors, as known in the art. Vacuum cleaner 100 or circuit board 260 can further comprise a "deadman" or "kill" switch which is capable of terminating power to the vacuum should the user become incapacitated. A temperature sensor 266 can determine the temperature of motor assembly 240, base 102, or other parts. Circuit board 260 can turn on an indicator light and/or terminate power to vacuum 100. Further, vacuum cleaner 100 or circuit board 260 can include a reset switch which is capable of resetting power to vacuum cleaner 100 or circuit board 260.

Figure 15:
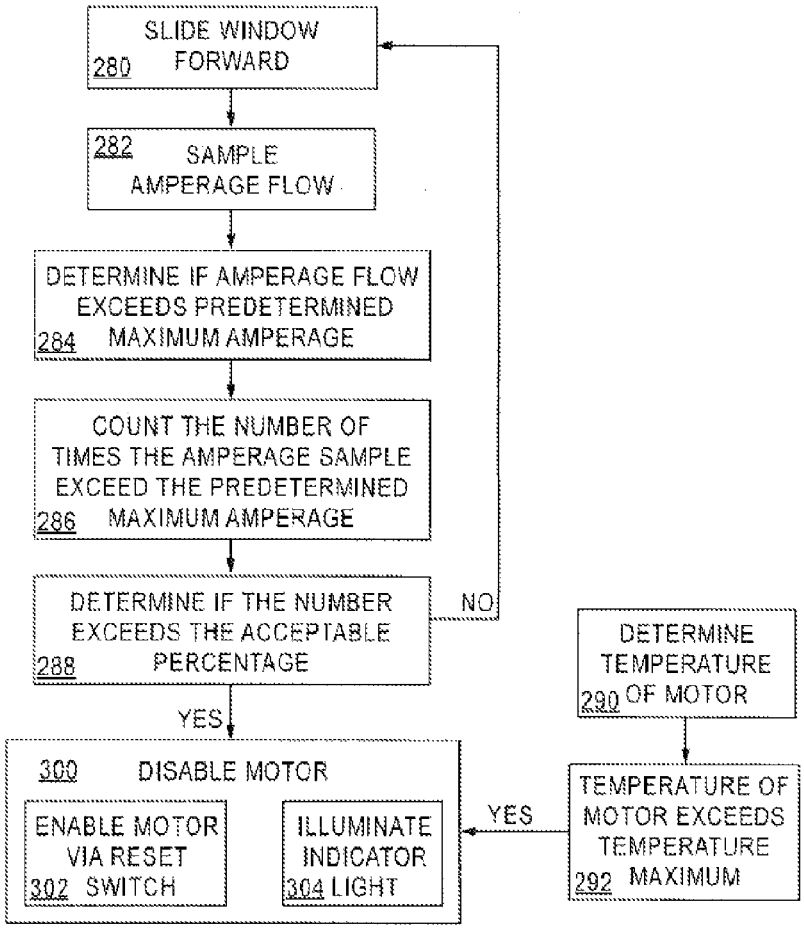
FIG. 15 illustrates a flow diagram indicating control mechanisms to shut down a motor according to one embodiment.
Figure 16:
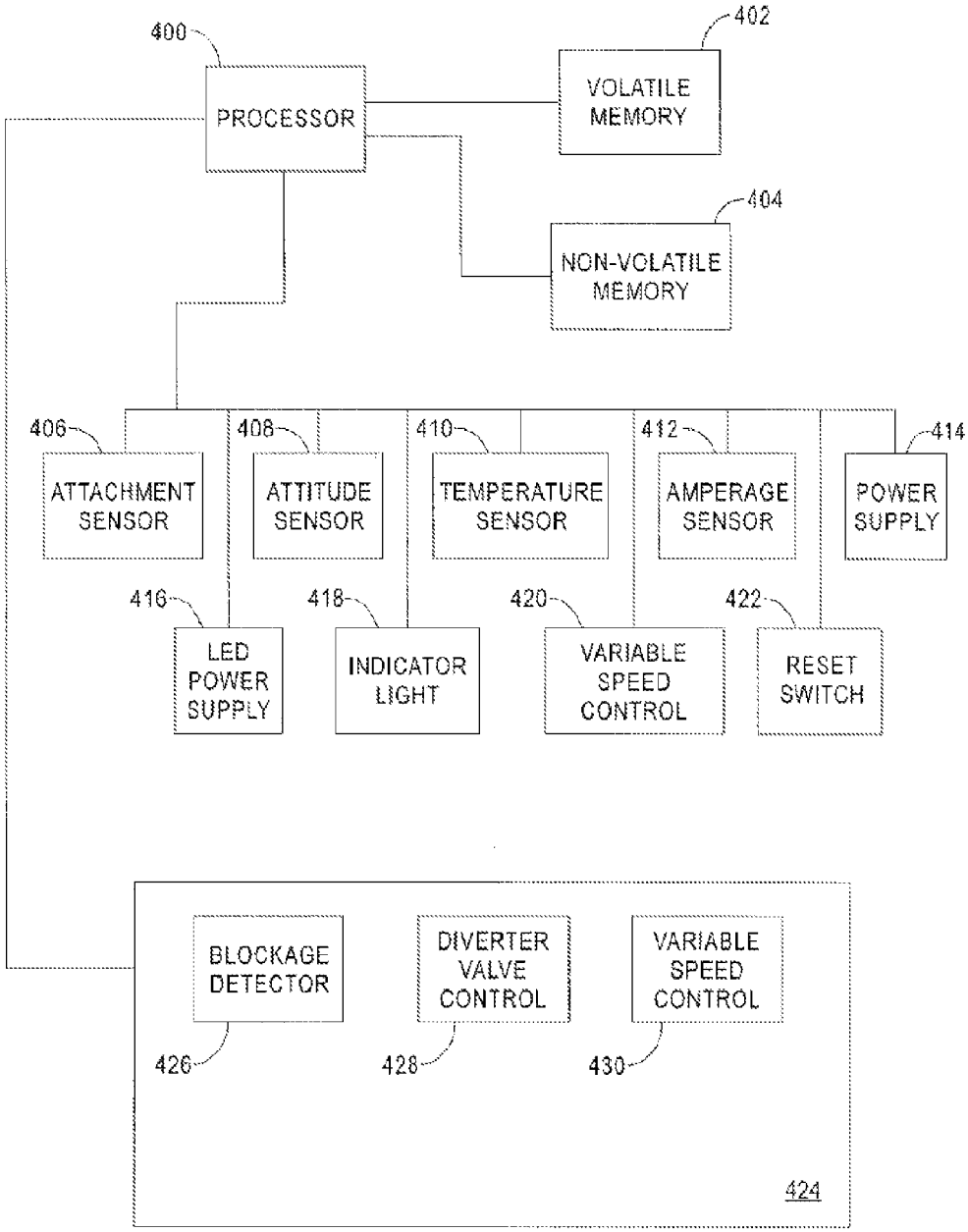
FIG. 16 illustrates a logical view of a system to control and manage a vacuum cleaner according to one embodiment.

As shown in FIG. 15, control mechanisms to shut down a vacuum motor are described. At step 280, the window of time slides or moves forward. At step 282, a samples of the amperage drawn by the motor is measured or determined. At step 284, the control determines if the amperage flow exceeds a predetermined maximum or threshold amperage. At step 286, the control counts the number of time the amperage samples exceeded the predetermined maximum amperage. The control determines if the number from step 286 exceeded the acceptable percentage within the single window of time at step 288. If the percentage of samples that exceeded the threshold is acceptable, the control repeats the process and begins at step 280 again. If the percentage of samples that exceeded the threshold is not acceptable, then the control turns off the current to the motor and shuts down the motor at step 300. The disablement of the motor can trigger the illumination of an indicator light at step 304. The motor can be enabled by the user via manually activating a reset switch at step 302.

The invention claimed is:

1. A vacuum comprising:
a handle;
a yoke connected to the handle;
a base separate from the yoke;
an axle connected to the yoke and the base;
an airflow duct exiting the base wherein the airflow duct is distinct from the handle;
a dirt collection device connected to the airflow duct; and
a sliding connector connecting the dirt collecting device to the handle.

2. The vacuum of claim 1, wherein the base comprises a lifting device that raises the base off the cleaning surface.

3. The vacuum of claim 2, wherein the lifting device comprises a wheel.

4. The vacuum of claim 2, wherein the lifting device comprises a biasing device to keep the lifting device receded into the base and a ramp to expel the lifting device from the base when the handle is placed in a locked position.

5. The vacuum of claim 1, wherein the handle is hollow and is adapted to receive an electrical cord.

6. The vacuum of claim 1, wherein the yoke includes a handle insert, wherein the handle receives the handle insert.

7. The vacuum of claim 6, wherein the handle insert includes an interior wall that divides the handle insert into two cavities, the interior wall includes a fastener receiver.

8. The vacuum of claim 1, further comprising a wheel connected to the axle.

* * * * *